US005954155A

United States Patent [19]

Panageotes

[11] Patent Number: 5,954,155

[45] Date of Patent: Sep. 21, 1999

[54] BRIDGE CONTAINMENT SYSTEM

[76] Inventor: Peter Panageotes, 404 Frank E. Rogers Blvd., Harrison, N.J. 07029

[21] Appl. No.: 09/236,404

[22] Filed: Jan. 25, 1999

[51] Int. Cl.[6] ..... E04G 21/30

[52] U.S. Cl. ..... 182/138; 182/150

[58] Field of Search ..... 182/138, 150, 182/113; 256/23, 46, DIG. 6, 65, 67

[56] References Cited

U.S. PATENT DOCUMENTS

| | | | |
|---|---|---|---|
| 4,057,943 | 11/1977 | Leinhard . | |
| 4,253,549 | 3/1981 | Petren . | |
| 4,413,707 | 11/1983 | Leinhard . | |
| 4,660,680 | 4/1987 | Pofin | 182/150 |
| 4,815,563 | 3/1989 | Puccinelli . | |
| 4,854,419 | 8/1989 | Lyras | 182/150 |
| 4,921,070 | 5/1990 | Magill | 182/150 |
| 5,299,655 | 4/1994 | Margantis | 182/150 |
| 5,579,866 | 12/1996 | Rowell . | |

*Primary Examiner*—Alvin Chin-Shue
*Attorney, Agent, or Firm*—Anthony D. Cipollone, Esq.

[57] ABSTRACT

A bridge containment system (10) comprises at least two vertically positioned cables (12) which comprise at least a first cable (12A) and a second cable (12B). The bridge containment system (10) farther comprises least two chains (16) interwoven and slidably mounted onto the plurality of vertically positioned cables (12), a first chain (16A) is interwoven and slidably mounted onto the first cable (12A) and a second chain (16B) is interwoven and slidably mounted onto the second cable (12B). The bridge containment system (10) further comprises at least one fence (18) is securely attached along a first distal edge to the first chain (16A) and securely attached along an opposite distal edge to the second chain (16B), when the first cable (12A) and the second cable (12B) are raised and lowered, the at least one fence (18) is concurrently raised and lowered functioning to contain falling debris.

8 Claims, 3 Drawing Sheets

BRIDGE CONTAINMENT SYSTEM

BACKGROUND OF THE INVENTION

1. Field of the Invention

The present invention relates to safety devices. More particularly, the present invention relates to devices which capture falling construction debris.

2. Description of the Prior Art

Numerous innovations for bridge containment system have been provided in the prior art that are described as follows. Even though these innovations may be suitable for the specific individual purposes to which they address, they differ from the present invention as hereinafter contrasted.

In U.S. Pat. No. 5,579,866, titled Suspended Access Platform, invented by Steven B. Rowell, a suspended access platform is described which can be easily disassembled and folded to facilitate storage or relocation of the platform. The components of the suspended access platform are connected together by recessed pockets on some components for accepting legs on other components and by lock-pin arrangements which include tethered pins which are permanently tethered to particular components of the platform. The suspended access platform has a folding floor which comprises two floor half panels which are hinged together to allow the floor to be folded. The floor is connected to side panels which in turn are connected to front and back stirrups or connecting frames. The stirrups are each comprised of two half stirrups which are rotatably connected by a hinging mechanism. When the half stirrups are locked in place, a suspension mechanism is removably fastened to the half stirrups. When the half stirrups are not locked in place the hinging mechanism allows the half stirrups to rotate with respect to one another once the suspension mechanism has been removed. The connecting frames are each comprised of two half frames which are rotatably connected by a hinging mechanism. The suspended access platform can be quickly assembled and disassembled and the floor, end stirrups and connecting frames can be folded to facilitate storage or transport of the components. The length of the platform may be easily modified by utilizing a folding connecting frame which incorporates a hinging mechanism.

The patented invention differs from the present invention because the patented invention is a suspended access platform as described which can be easily disassembled and folded to facilitate storage or relocation of the platform. The platform is suspended from a vertical suspension device and is positioned vertically along that device. The patented invention is a rigid structure which by design is weighty and complex and does not permit cost effective suspension under large surface areas of overhead support structures. The present invention is a plurality of fences which are suspended horizontally underneath a overhead structure. The present invention is a cost effective device for capturing debris and serve as a safety net.

In U.S. Pat. No. 4,815,563, titled Adjustable Post and Method of Using the Post to Erect Suspension Scaffolding, invented by Joseph S. Puccinelli and Peter T. Foseid, an adjustable comer post for suspension scaffolding is described in which an outer tube is concentric to an elongated member such as a wire rope or rod and has an internal thread in a nut at one end. A tubular adjusting screw having an external thread is concentric to the elongated member and screws into the thread of the outer tube for reacting directly or indirectly with the elongated member so the outer tube rises and lowers when the screw is rotated in opposite directions. A platform supporting structure is supported on the adjustable posts and is leveled by selective rotation of the screws. A method of assembling suspension scaffolding using the adjustable posts is described.

The patented invention differs from the present invention because the patented invention is an adjustable comer post for suspension scaffolding. The patented invention lacks features similar to the present invention.

In U.S. Pat. No. 4,413,707, titled Suspended Chain Scaffolding Employing Adjustable Posts with Chain Threaded, invented by Robert W. Lienhard, Sr., a chain supported scaffolding arrangement is described for use inside of a building or vessel or in working under a bridge. Chain gripping plates engage the chain and support hollow tubular vertical posts which have a plurality of receptacles connected thereto. The chain engaging plates have a recess formed therein for receiving and positioning the vertical posts. Horizontal members engage the receptacles and extend between the vertical posts which are supported from the chains. The horizontal members are connected to the vertical posts by connectors which prevent movement about their connection axes so that when the various horizontal and vertical members are interconnected, a relatively stiff structure, which is chain supported, is provided.

The patented invention differs from the present invention because the patented invention is a chain supported scaffolding arrangement is described. The patented invention suspend a rigid structure from vertical chains. In the present invention the chains are attached to horizontal suspension wires and the horizontal suspension wires may be woven through the chain. The patented invention lacks features similar to the present invention.

In U.S. Pat. No. 4,253,549, titled Method and a System for the Erection of High Buildings, invented by Rolf A. M. Petren, a scaffolding system is described for use at the erection of high buildings and solves the problem of providing a suspended scaffold which is stepwise lifted to higher levels but yet in constant communication with ground level. The patented system comprises two scaffold categories the one (1) being permanently directly accessible from ground and the other (2, 3) being successively lifted to higher levels and, between the lifting operations, held suspended from the building itself rather than from lifting cranes.

The patented invention differs from the present invention because the patented invention is a rigid scaffolding system. The patented invention must be positioned using an overhead crane. The patented invention functions with a chain suspension system wherein the chains engage chain receptors securely attached to a vertical structure. The present invention is a device which is generally horizontally rigged under a bridge structure or other generally horizontal structure. The present invention functions to capture debris and provide a movable safety net. The present invention is suspended from horizontal cables.

In U.S. Pat. No. 4,057,943, titled Modular Scaffolding for Assembling the Inside of a, invented by Robert W. Lienhard, a scaffolding arrangement is provided having removable bottom supports and adjustable outriggers for assembling the insulation and inner membrane of a liquefied natural gas (LNG) tank. A structural steel base is provided from which the scaffolding is supported.

The structural steel base is supported from the bottom of the LNG vessel by adjustable screw jack supports. The inside of the LNG vessel is coated with various layers of insulating and support material and a final inner layer or membrane of stainless steel is provided over the insulation and other associated material. Any screw jack support can be removed, when adjacent screw jack supports are in place, allowing installation of the insulation and membrane in that area. Vertical supports are provided throughout the inside of the LNG vessel above the structural steel base. A plurality of horizontal spaced apart levels are formed within the LNG vessel to divide the inside of the vessel into a plurality of work platforms. The horizontal work platforms are formed from horizontally disposed structural members which are supported solely from the vertical columns. Thus, no cross bracing is required on the inside of the vessel. Except for the vertical support columns the horizontal work areas or platforms are open. The open work areas permit the easy use of mechanical handling equipment which is required for moving, installing and testing the insulation and corrosion resistant inner layer.

The fixed horizontal work platform terminates a distance from the side of the LNG vessel. Adjustable outrigger members are provided between the fixed horizontal work platform and the side of the vessel. These adjustable outrigger members can be extended out to come into close proximity to the side of the vessel. Thus the work platform can be extended as close to the side of the vessel as desired. As the insulating layers on the side of the LNG vessel are built up, the outriggers are retracted accordingly. Thus, at all times the work platform can be close to the point where insulation or stainless steel membrane is being applied or tested. The vertical and horizontal scaffolding have connectors formed integrally therewith for easy connection or attachment to the associated scaffolding members.

The patented invention differs from the present invention because the patented invention is a rigid scaffolding system. The present invention is a device which is generally horizontally rigged under a bridge structure or other generally horizontal structure. The present invention functions to capture debris and provide a movable safety net. The present invention is suspended from horizontal cables.

Numerous innovations for bridge containment system have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a device which is generally horizontally rigged under a bridge structure or other generally horizontal structure. The present invention functions to capture debris and provide a movable safety net. A plurality of suspension cables are rigged horizontally under a bridge structure by attaching both ends to a support structure. At the limits of the bridge structure a plurality of out rigging devices functioning to position a cable outward of a support I-Beam. The out rigging devices are attached to the I-beams by an outrigger fastening means functioning to securely attach the plurality of out rigging devices to an I-beam. A plurality of suspension chains having attachment means positioned at the ends and middle points are attached to the suspension cables. The suspension cables may be woven through the links of the chain. A plurality of fence devices are attached by an attachment means to the links of the chains. The plurality of suspension chains as described above wherein the attachment means engages the plurality of suspension cables functioning to provide easy attachment, secure holding and prevent slipping along the cables when in a secure position, yet permit sliding the chains along to wire to a new position when in a movable position.

The types of problems encountered in the prior art are providing a easily erecting and movable barrier for falling construction debris.

In the prior art, unsucessful attempts to solve this problem were attempted namely: scaffolding and netting which is time consuming to install and move. However, the problem was solved by the present invention because simple suspension system permits movement of the barrier and easy installation under a bridge like structure.

The present invention went contrary to the teaching of the art which shows complex fixed barriers which are difficult to move to follow work progress.

The present invention solved a long felt need for a debris barrier which can be attached to the under side of bridges during construction.

Accordingly, it is an object of the present invention to provide a bridge containment system for debris and worker safety.

More particularly, it is an object of the present invention to provide a plurality of cables which are attached to a plurality of cross beams. The plurality of cables support a netting material.

When the bridge containment system is designed in accordance with the present invention, worker safety is improved.

In accordance with another feature of the present invention, a plurality of chains are suspended from a structural member. The netting is attached to the chains by a fastening means.

Another feature of the present invention is that the plurality of nettings may be a plurality of fences. Yet another feature of the present invention is that a hoist clamp having a hoist clamp guide is attached to an I-beam. The hoist clamp hoist clamp pulley (20B) rotatably positioned therein.

Still another feature of the present invention is that a hoist clamp guide has a hoist clamp pulley.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10—bridge containment system (10)
12—cable (12)
12A—first cable (12A)
12B—second cable (12B)
12C—third cable (12C)
14—cross beam (14)
14AA—first left-right cross beam (14AA)
14AB—first right-left cross beam (14AB)
14BA—second left-right cross beam (14BA)
14BB—second right-lef cross beam (14BB)
16—chain (16)
16A—first chain (16A)
16B—second chain (16B)
18—fence (18)
18A—first fence (18A)
18B—second fence (18B)
18C—third fence (18C)
20—hoist clamp (20)

20A—hoist clamp guide (20A)
20B—hoist clamp pulley (20B)
20C—hoist clamp pin (20C)
22—out rigging (22)
22A—out rigging clamp (22A)
22B—out rigging extender (22B)
22C—out rigging guide (22C)
24—I-beam (24)
24A—first I-beam (24A)
24B—second I-beam (24B)
24C—third I-beam (24C)

DESCRIPTION OF THE PREFERRED EMBODIMENT

Figure 1:
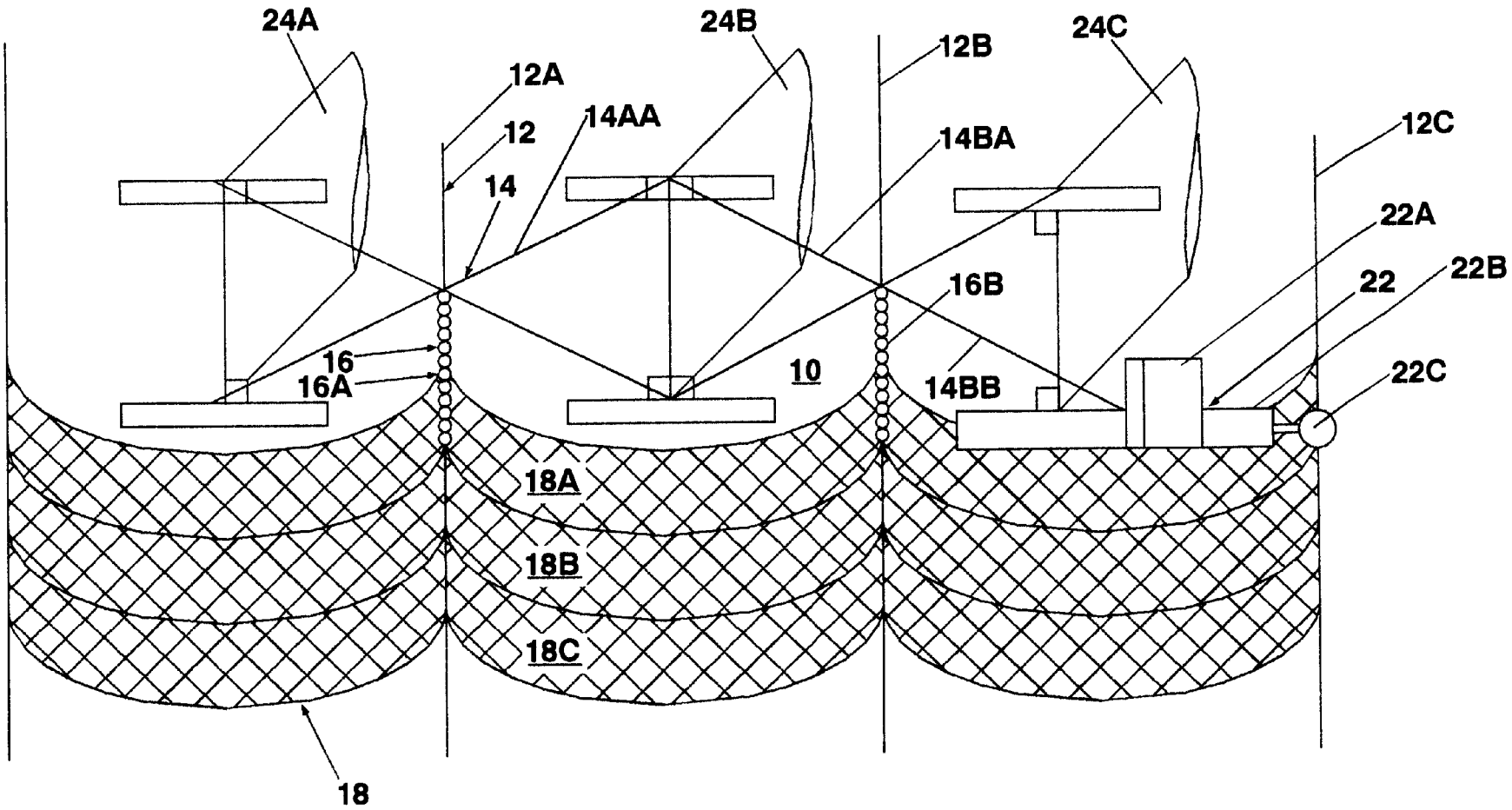
FIG. 1 is a end view of a bridge containment system.

Firstly, referring to FIG. 1 which is an end view of a bridge containment system (10) which comprises at least two vertically positioned cables (12) which comprise at least a first cable (12A) and a second cable (12B). The bridge containment system (10) further comprises least two chains (16) interwoven and slidably mounted onto the plurality of vertically positioned cables (12), a first chain (16A) is interwoven and slidably mounted onto the first cable (12A) and a second chain (16B) is interwoven and slidably mounted onto the second cable (12B). The bridge containment system (10) further comprises at least one fence (18) is securely attached along a first distal edge to the first chain (16A) and securely attached along an opposite distal edge to the second chain (16B), when the first cable (12A) and the second cable (12B) are raised and lowered, the at least one fence (18) is concurrently raised and lowered functioning to contain falling debris.

The bridge containment system (10) further comprises at least three I-beams (24) comprise a first I-beam (24A), a second I-beam (24B), and a third I-beam (24C). A cross beam (14) comprises a first left-right cross beam (14AA) and a first right-left cross beam (14AB) is connected between the first I-beam (24A) and the second I-beam (24B). A second left-right cross beam (14BA) and a second right-left cross beam (14BB) is connected between the second I-beam (24B) and the third I-beam (24C). The first cable (12A) is fastened to a junction between the first left-right cross beam (14AA) and the first right-left cross beam (14AB). The second cable (12B) is fastened to a junction between the second left-right cross beam (14BA) and the second right-left cross beam (14BB).

The bridge containment system (10) further comprises at least one out rigging (22) attached to the third I-beam (24C), a third cable (12C) is movably positioned within the at least one out rigging (22). The out rigging (22) comprises an out rigging clamp (22A) securely attached to the third I-beam (24C) and an out rigging extender (22B) securely attached at an inner distal end to the out rigging clamp (22A), an out rigging guide (22C) is securely attached at an outer distal end of the out rigging extender (22B) through which the third cable (12C) is movably positioned.

The at least one fence (18) is a first fence (18A), second fence (18B), and third fence (18C). Which are concurrently raised and lowered functioning to contain falling debris.

Figure 2:
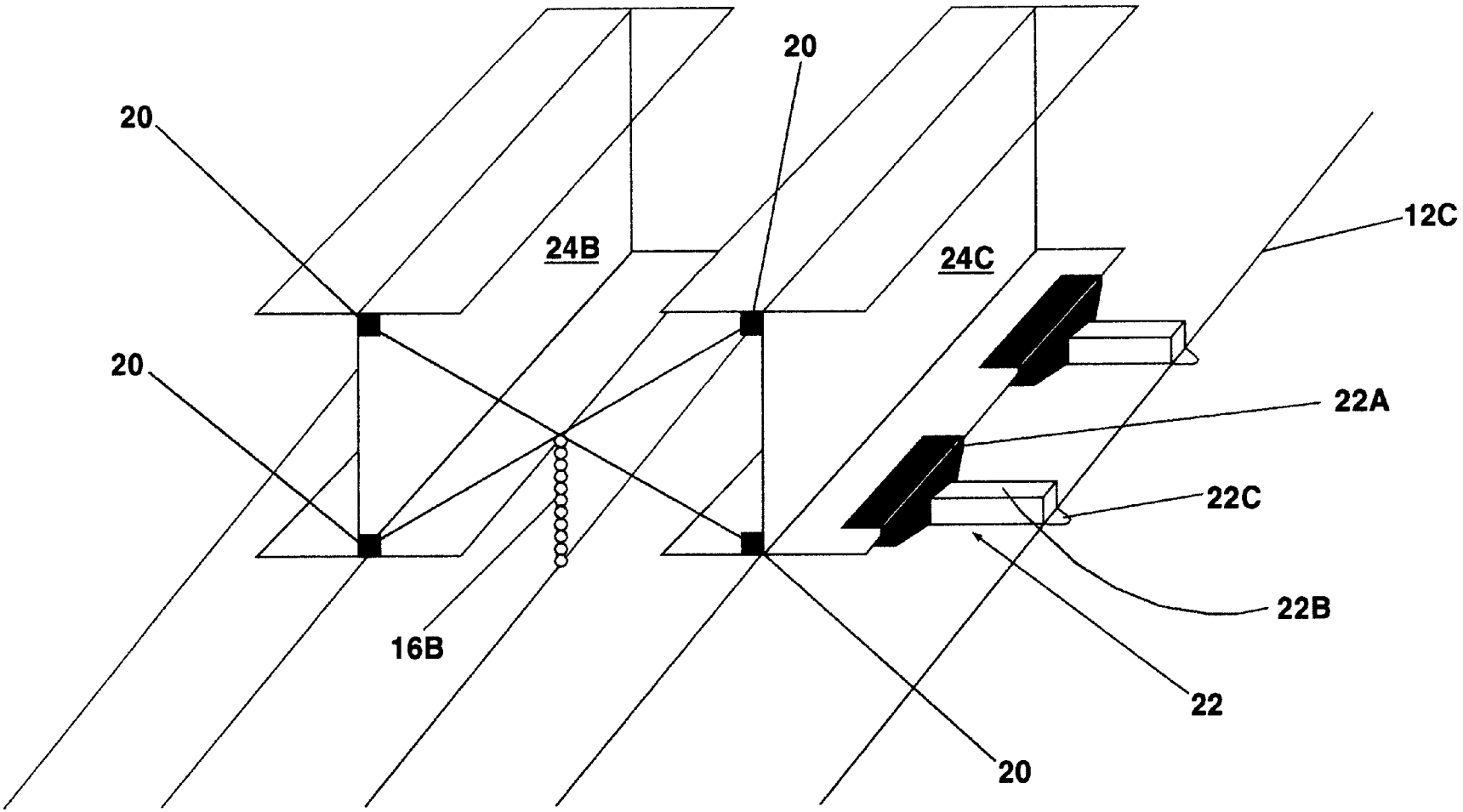
FIG. 2 is a perspective view of a bridge containment system.

Secondly, referring to FIG. 2 which is a perspective view of a bridge containment system (10) which comprises at least one hoist clamp (20) which securely fastened to the I-beam (24), the cable (12) is movably positioned through the at least one hoist clamp (20). The at least one hoist clamp (20) comprises a hoist clamp guide (20A) having a hoist clamp pulley (20B) rotatably positioned therein. The at least one hoist clamp (20) further comprises a hoist clamp pin (20C) therethrough, the cable (12) is movably positioned through the at least one hoist clamp (20) between the hoist clamp pulley (20B) and the hoist clamp pin (20C).

The bridge containment system (10) further comprises at least one out rigging (22) attached to the third I-beam (24C), a third cable (12C) is movably positioned within the at least one out rigging (22). The out rigging (22) comprises an out rigging clamp (22A) securely attached to the third I-beam (24C) and an out rigging extender (22B) securely attached at an inner distal end to the out rigging clamp (22A), an out rigging guide (22C) is securely attached at an outer distal end of the out rigging extender (22B) through which the third cable (12C) is movably positioned.

Figure 3:
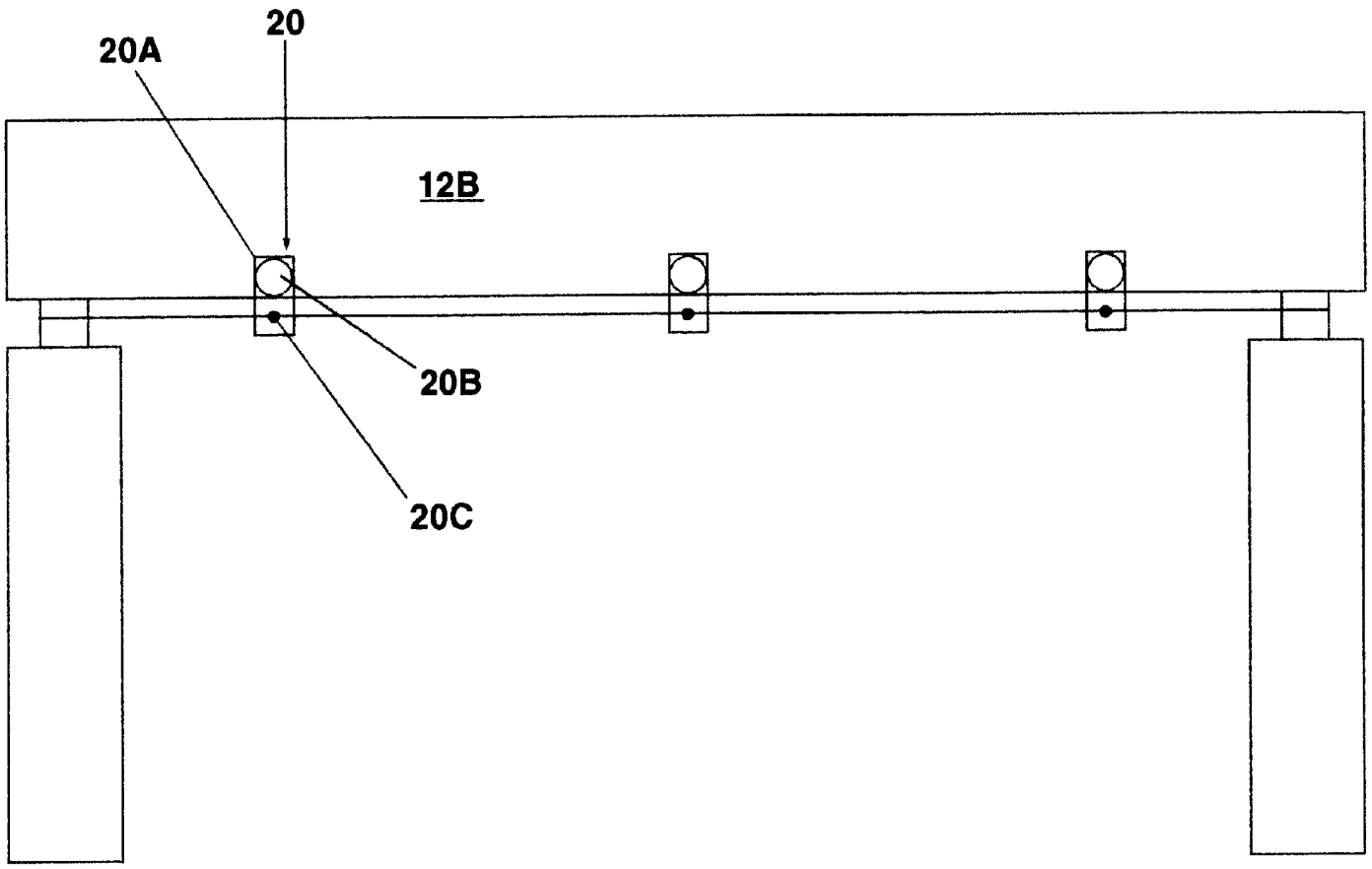
FIG. 3 is a side view of a bridge containment system.

Lastly, referring to FIG. 3 which is a side view of a bridge containment system which comprises a second cable (12B). The bridge containment system (10) which comprises at least one hoist clamp (20) which is securely fastened to the I-beam (24), the cable (12) is movably positioned through the at least one hoist clamp (20). The at least one hoist clamp (20) comprises a hoist clamp guide (20A) having a hoist clamp pulley (20B) rotatably positioned therein. The at least one hoist clamp (20) further comprises a hoist clamp pin (20C) therethrough, the cable (12) is movably positioned through the at least one hoist clamp (20) between the hoist clamp pulley (20B) and the hoist clamp pin (20C).

The bridge containment system (10) further comprises at least three I-beams (24) comprise a first I-beam (24A), a second I-beam (24B), and a third I-beam (24C). A cross beam (14) comprises a first left-right cross beam (14AA) and a first right-left cross beam (14AB) is connected between the first I-beam (24A) and the second I-beam (24B). A second left-right cross beam (14BA) and a second right-left cross beam (14BB) is connected between the second I-beam (24B) and the third I-beam (24C). The first cable (12A) is fastened to a junction between the first left-right cross beam (14AA) and the first right-left cross beam (14AB). The second cable (12B) is fastened to a junction between the second left-right cross beam (14BA) and the second right-left cross beam (14BB).

The bridge containment system (10) further comprises at least one hoist clamp (20) which securely fastened to the I-beam (24), the cable (12) is movably positioned through the at least one hoist clamp (20). The at least one hoist clamp (20) comprises a hoist clamp guide (20A) having a hoist clamp pulley (20B) rotatably positioned therein. The at least one hoist clamp (20) further comprises a hoist clamp pin (20C) therethrough, the cable (12) is movably positioned through the at least one hoist clamp (20) between the hoist clamp pulley (20B) and the hoist clamp pin (20C).

The bridge containment system (10) further comprises at least one out rigging (22) attached to the third I-beam (24C), a third cable (12C) is movably positioned within the at least one out rigging (22). The out rigging (22) comprises an out rigging clamp (22A) securely attached to the third I-beam (24C) and an out rigging extender (22B) securely attached at an inner distal end to the out rigging clamp (22A), an out rigging guide (22C) is securely attached at an outer distal end of the out rigging extender (22B) through which the third cable (12C) is movably positioned.

The at least one fence (18) is a first fence (18A), second fence (18B), and third fence (18C).

It will be understood that each of the elements described above, or two or more together, may also find a useful application in other types of constructions differing from the type described above.

While the invention has been illustrated and described as embodied in a bridge containment system, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A bridge containment system (10) comprising:

A) at least two vertically positioned cables (12) which comprise at least a first cable (12A) and a second cable (12B);

B) at least two chains (16) interwoven and slidably mounted onto the plurality of vertically positioned cables (12), a first chain (16A) is interwoven and slidably mounted onto the first cable (12A) and a second chain (16B) is interwoven and slidably mounted onto the second cable (12B);

C) at least one fence (18) is securely attached along a first distal edge to the first chain (16A) and securely attached along an opposite distal edge to the second chain (16B), when the first cable (12A) and the second cable (12B) are raised and lowered, the at least one fence (18) is concurrently raised and lowered functioning to contain falling debris.

2. The bridge containment system (10) as described in claim 1 further comprises at least three I-beams (24) which comprise a first I-beam (24A), a second I-beam (24B), and a third I-beam (24C), a cross beam (14) which comprises a first left-right cross beam (14AA) and a first right-left cross beam (14AB) is connected between the first I-beam (24A) and the second I-beam (24B), a second left-right cross beam (14BA) and a second right-left cross beam (14BB) is connected between the second I-beam (24B) and the third I-beam (24C), the first cable (12A) is fastened to a junction between the first left-right cross beam (14AA) and the first right-left cross beam (14AB), the second cable (12B) is fastened to a junction between the second left-right cross beam (14BA) and the second right-left cross beam (14BB).

3. The bridge containment system (10) as described in claim 1 further comprises at least one hoist clamp (20) securely fastened to the I-beam (24), the cable (12) is movably positioned through the at least one hoist clamp (20).

4. The bridge containment system (10) as described in claim 3, wherein the at least one hoist clamp (20) comprises a hoist clamp guide (20A) having a hoist clamp pulley (20B) rotatably positioned therein.

5. The bridge containment system (10) as described in claim 4, wherein the at least one hoist clamp (20) further comprises a hoist clamp pin (20C) therethrough, the cable (12) is movably positioned through the at least one hoist clamp (20) between the hoist clamp pulley (20B) and the hoist clamp pin (20C).

6. The bridge containment system (10) as described in claim 1 further comprises at least one out rigging (22) attached to the third I-beam (24C), a third cable (12C) is movably positioned within the at least one out rigging (22).

7. The bridge containment system (10) as described in claim 6, wherein the out rigging (22) comprises an out rigging clamp (22A) securely attached to the third I-beam (24C) and an out rigging extender (22B) securely attached at an inner distal end to the out rigging clamp (22A), an out rigging guide (22C) is securely attached at an outer distal end of the out rigging extender (22B) through which the third cable (12C) is movably positioned.

8. The bridge containment system (10) as described in claim 1, wherein the at least one fence (18) is a first fence (18A), second fence (18B), and third fence (18C).

* * * * *